US006449997B1

(12) United States Patent
Bertolini

(10) Patent No.: US 6,449,997 B1
(45) Date of Patent: Sep. 17, 2002

(54) PROCESS FOR METAL WIRE DRAWING AND A TOOL FOR ACTUATING THE PROCESS

(75) Inventor: Pietro Bertolini, Terenzo (IT)

(73) Assignee: I.F.I.CO.M. S.r.l. Immobiliare Finanziaria, Montesilvano (IT)

( * ) Notice: Subject to any disclaimer, the term of this patent is extended or adjusted under 35 U.S.C. 154(b) by 0 days.

(21) Appl. No.: 09/744,573

(22) PCT Filed: Jul. 9, 1999

(86) PCT No.: PCT/IT99/00211

§ 371 (c)(1),
(2), (4) Date: Jan. 26, 2001

(87) PCT Pub. No.: WO00/06316

PCT Pub. Date: Feb. 10, 2000

(30) Foreign Application Priority Data

Jul. 27, 1998 (IT) ..... MO98A0173

(51) Int. Cl.[7] ..... B21C 3/04; B21C 1/04; B21B 45/02

(52) U.S. Cl. ..... 72/41; 72/278; 72/467; 72/282

(58) Field of Search ..... 72/278, 282, 467, 72/41, 43

(56) References Cited

U.S. PATENT DOCUMENTS 2,088,040 A * 7/1937 Simons ..... 72/282
4,270,373 A * 6/1981 Hirato ..... 72/41
4,549,421 A * 10/1985 Hashmi ..... 72/467

FOREIGN PATENT DOCUMENTS

| | | | | |
|---|---|---|---|---|
| AT | 342 542 B | | 4/1978 | |
| DE | 1953151 | * | 4/1971 | 72/282 |
| EP | 0 537 618 A | | 4/1993 | |
| GB | 578 066 A | | 7/1946 | |
| JP | 162520 | * | 8/1985 | 72/467 |
| JP | 219416 | * | 9/1986 | 72/282 |

OTHER PUBLICATIONS

"Patent Abstracts of Japan" vol. 010, No. 381 (M–547), Dec. 19, 1986 (61172612).

"Patent Abstracts of Japan" vol. 1996, No. 08, Aug. 30, 1996 (08108211).

* cited by examiner

*Primary Examiner*—Daniel C. Crane

(57) ABSTRACT

In an improved process for drawing metal wires and a tool for actuating the process, a metal wire is coated with a thin surface layer of lubricant and subsequently drawn, gradually in a series of single drawing operations. In a final of the drawing operations, the wire is forced to pass through a hole which exhibits an angle of convergence comprised between 30 degrees and about 85 degrees. As the wire passes through the hole, the layer of lubricant is removed and the drawn wire exiting from the hole is clean and lubricant-free.

6 Claims, 1 Drawing Sheet

PROCESS FOR METAL WIRE DRAWING AND A TOOL FOR ACTUATING THE PROCESS

The present application is the national stage under 35 U.S.C. 371 of PCT/IT99/00211, filed Jul. 9, 1999.

TECHNICAL FIELD

The invention relates to a drawing process where the metal wire is coated with a thin surface layer of material to improve drawing, the wire being passed through several different drawing holes.

BACKGROUND ART

A process of the above-described type is known, in which the wire is coated with a lubricant which serves both to reduce friction during the forced passage through the draw-plate and to obtain a wire with a smooth surface and a constant section. Prior-art drawplates exhibit a reduction tract, where the metal wire is subjected to plastic deformation. This reduction tract has an angle of convergence which is normally comprised between 12 and 14°, but in any case never exceeds 20–25°. EP-A-0 537 618 discloses a process for metal wire drawing in which a metal wire, previously coated by a layer of material for aiding the subsequent drawing operation, is drawn by means of a series of drawing operations. The wire passes through a series of draw-plates in order to reach its final section size. The draw-plates have holes each exhibiting a reduction tract which produce a plastic deformation of the wire. The angle of convergence of the reduction tracts is less than 25°.

This is due to the fact that drawplates wit holes having an angle of convergence above this produce irregular drawing results thanks to excessive traction forces on the wire, which can be exacerbated to the point of breakage in further drawing operations. In any case, such levels of traction lead to rapid wear on the wire. Prior-art drawing processes of the above type generally comprise a further phase, after the last of the drawing operations, in which the wire is treated to remove the surface layer of lubricant. This leads to several drawbacks. Firstly, the process is made complicated by the need to predispose suitable equipment for removing the lubricant from the wire after the process; secondly, working times are considerably affected, with consequent increases in manufacturing costs.

OBJECT AND SUMMARY OF THE INVENTION

The main aim of the present invention is to eliminate the above-described drawbacks by providing an improved drawing process in which a surface layer of the wire can be removed simply and economically.

An advantage of the invention is that after the final drawing stage a subsequent phase is not necessarily required in order to remove a coating from the wire. A further advantage of the present invention is that a high-quality metal wire is obtained, having a smooth external surface and straight constant transversal section.

A further aim of the present invention is to provide a tool which simply and economically removes a surface layer of coating from the metal wire being drawn.

BRIEF DESCRIPTION OF THE DRAWINGS

Further characteristics and advantages of the present invention will better emerge from the detailed description that follows of a preferred but non-exclusive embodiment of the invention, illustrated purely by way of a non-limiting example in the accompanying figure of the drawing, in which.

DETAILED DESCRIPTION OF THE PREFERRED EMBODIMENT(S) OF THE INVENTION

Figure 1:
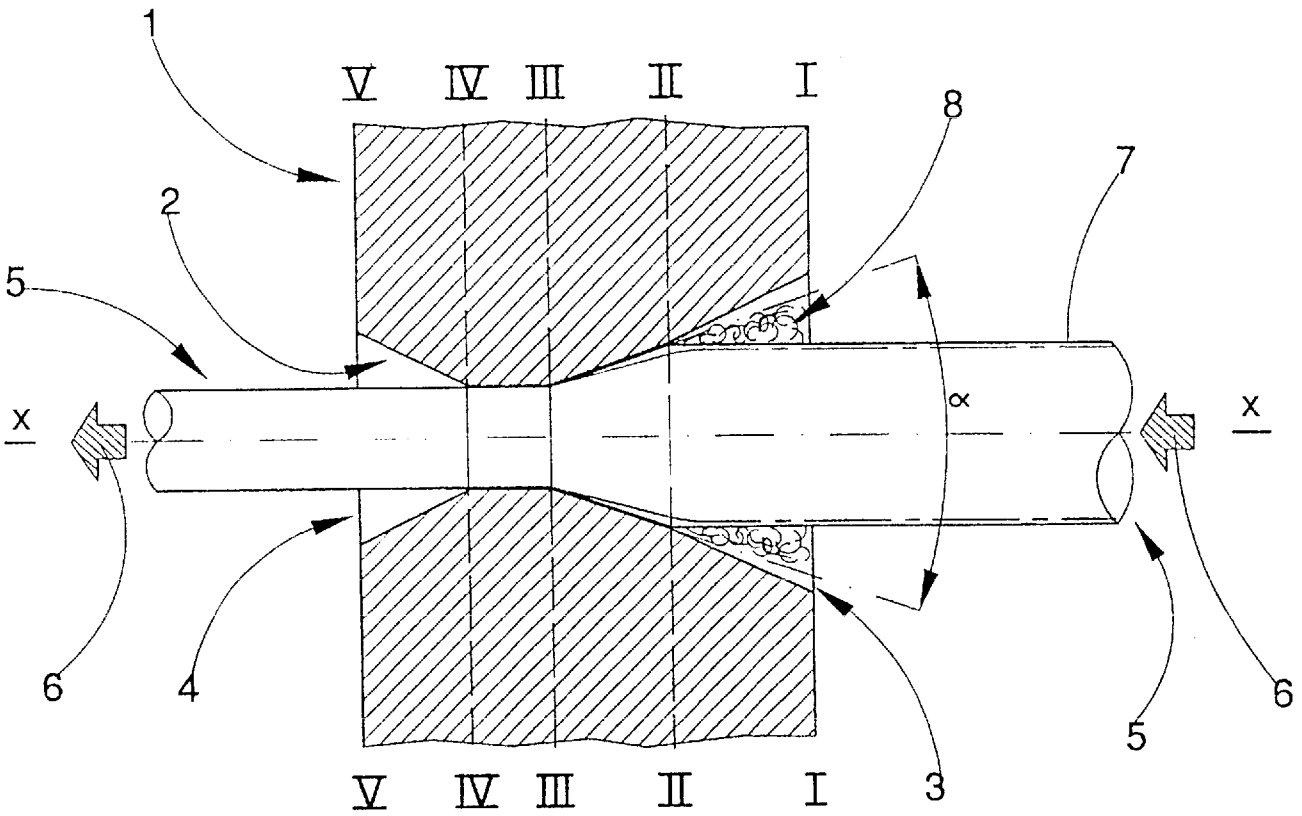
FIG. 1 shows a schematic and partial longitudinal section of a draw-plate according to the invention during use.

With reference to FIG. 1, 1 denotes in its entirety a tool for drawing metal wires, which comprises a draw-plate with a hole 2 having a longitudinal axis x—x, an inlet 3 and an outlet 4 for a metal wire 5. Arrows 6 indicate the wire advancement direction as it passes through the tool 1. The tool 1 is in fact the last draw-plate of a series thereof through which the wire passes in order to reach its final section size. Using Roman numerals I to V, five planes orthogonal to the axis x—x are indicated, arranged one after another in the advancement direction 6 of the wire 5 and distanced one from another so that they identify 4 distinct but coaxial zones of the drawplate tool 1.

The first zone, comprised between planes I—I and II—II, is cone-shaped in order for the wire to be introduced; for this reason the angle of convergence can be quite large. This first cone I—I performs no plastic deformation on the wire 5, merely introducing it into the body of the tool 1.

The second zone, comprised between II—II and III—III, comprises a converging reduction cone, with an angle $\alpha$ of convergence which in the embodiment illustrated is about 32–33°. The wire 5 is subjected to plastic deformation in this zone. This is in fact the most important part of the draw-plate tool 1, as it is here that the wire section is reduced.

The angle of convergence of the first zone (introduction cone) can advantageously be equal to the angle of convergence of the second zone (reduction cone). The too cones could be made into one continuous cone, with no change in the angle of convergence, which would make the tool 1 easier to manufacture.

The third zone, comprised between planes III—III and IV—IV, is a constant-section cylinder, having a same diameter as the wire diameter D2 on completion of drawing, i.e. as it exits the output 4. The fourth zone, comprised between plates IV—IV and V—V, is an outlet cone, with a relatively large angle of divergence which does not interact contactingly with the drawn metal wire 5.

In other embodiments, not illustrated, of the invention, the angle $\alpha$ of convergence of the second reduction zone can be different from the one shown in FIG. 1; in the further embodiments, the angle $\alpha$ of convergence is preferably comprised between 30 and 85 degrees and is in any case more than about 30°. Also possible would be angles $\alpha$ of convergence considerably greater than 85°, indeed, it would be possible to use angles of up to 120° and above.

The tool 1 can be used to actuate a metal wire drawing process as in the present invention. The process involves coating the wire to be drawn with a thin layer 7 of material which aids the subsequent drawing. The above-mentioned material might be, for example, a lubricant reducing friction during drawing, giving a drawn wire with a smooth surface and constant section.

The process reduces the section of the wire 5 by a series of gradual drawing operations. In the first operations, but excluding the final one, the drawing holes have a relatively small angle of convergence, for example between 12° and 14°, and in any case less than 25°. In the final operation, the tool 1 as described herein is used, with an angle of convergence as shown between planes II—II and III—III, exhibiting a relatively high angle α of convergence, greater than 30° and preferably between 30° and 85°. Angles α above 85° can be used.

The metal wire 5 at the inlet 3 to the final draw-plate, i.e. the tool 1, has a diameter D1, while at the outlet the diameter is D2, smaller than D1. Furthermore the metal wire 5 at the inlet 3 has a layer of surface coating 7, relatively thin, made, for example of a lubricating material. Experiments have shown that when the metal wire 5 passes through the hole 2 of the draw-plate 1, the layer of surface coating 7 does not pass trough, being stopped at the start of the reduction passage from II—II to III—III and being removed to form a waste scarf which rolls back towards the inlet 3 of the hole 2, whence it can be easily removed.

At the outlet 4 the metal wire 5 exhibits a diameter D2 which is smaller than D1 at the inlet 3, and further exhibits a smooth external surface cleaned of the layer 7 of material it presented at the inlet 3.

The tool 1 therefore has a double function; firstly it reduces the section of the wire, through a drawing action; then it removes the layer of lubricant coating the wire, through a sort of scouring of the lubricant.

The choice of the shape of the tool 1 (especially the choice of the angle α of convergence at the inlet 3 and the outlet 4 of the reduction cone) depends on various factors. In particular it is necessary to find a proper balance among the following three parameters: the percentage of reduction of the wire section; the degree of wire cleanliness required (which increases proportionately as the angle α increases) and the working life of the tool (which increases as angle α is reduced),

What is claimed is:

1. A process for drawing a metal wire (5), comprising the steps of:

coating a layer (7) of material on a metal wire (5) to aid a subsequent drawing thereof, drawing the metal wire (5) through a through hole in each of a series of drawplates before drawing through a final drawplate, each said through hole of the series of drawplates having a reduction tract and an angle α of convergence less than 25°;

a final through hole of the final drawplate having a reduction tract with an angle (α) of convergence greater than 30°;

wherein drawing of the metal wire (5) through the reduction tract of the series of drawplates and the final drawplate produces plastic deformation of the metal wire (5).

2. The process according to claim 1, wherein the final through hole has a reduction tract having an angle (α) of convergence between 30° and 85°.

3. The process according to claim 1, wherein the final through hole has a converging zone before a reduction tract in the final drawplate which has an angle (α) of convergence equal to that of the reduction tract in the final drawplate, the converging zone does not contribute to plastic deformation of the wire (5) and is joined continuously to the reduction tract in the final drawplate so as to form a single converging tract therewith.

4. An apparatus for metal wire drawing, comprising a series of drawplates with holes through which a wire passes in order to each final section size thereof, said holes each having a reduction tract which produce a plastic deformation of the wire, said holes other than that of a last drawplate of the series each exhibiting an angle of convergence which is less than 25°, wherein the last drawplate of the series has at least one drawing hole (2) having a reduction tract exhibiting an angle (α) of convergence greater than 30°.

5. The apparatus of claim 4, wherein the angle (α) of convergence of the last draw plate is between 30° and 85°.

6. The apparatus of claim 4, wherein the angle (α) of convergence of the last drawplate is greater than 85°.

* * * * *

UNITED STATES PATENT AND TRADEMARK OFFICE

CERTIFICATE OF CORRECTION

PATENT NO. : 6,449,997 B1
DATED : September 17, 2002
INVENTOR(S) : Bertolini

It is certified that error appears in the above-identified patent and that said Letters Patent is hereby corrected as shown below:

Title page,
Item [73], after "Finanziaria" insert -- Costruzioni Milano --.

Signed and Sealed this

Eleventh Day of March, 2003

JAMES E. ROGAN
*Director of the United States Patent and Trademark Office*